United States Patent [19]

Ratcliff

[11] Patent Number: 4,717,218

[45] Date of Patent: Jan. 5, 1988

[54] ELECTRIC CIRCUIT BOARD ASSEMBLY

[75] Inventor: Colin K. Ratcliff, Sandy Hook, Conn.

[73] Assignee: Allied Corporation, Morris Township, Morris County, N.J.

[21] Appl. No.: 855,273

[22] Filed: Apr. 24, 1986

[30] Foreign Application Priority Data

Apr. 29, 1985 [GB] United Kingdom ..... 8510839

[51] Int. Cl.[4] ..... H01R 9/09

[52] U.S. Cl. ..... 439/59

[58] Field of Search ..... 339/17 L, 17 LC, 17 LM, 339/75 MP, 91 R, 125 R, 126 R, 128, 176 MP

[56] References Cited

U.S. PATENT DOCUMENTS

| | | | |
|---|---|---|---|
| 2,928,063 | 3/1960 | Gammel, Sr. | 339/17 L |
| 3,297,977 | 1/1967 | Smith | 339/126 R |
| 3,932,016 | 1/1976 | Ammenhauser | 339/75 MP |
| 3,970,353 | 7/1976 | Kaufman | 339/75 MP |
| 4,185,882 | 1/1980 | Johnson | 339/176 MP |
| 4,416,496 | 11/1983 | Brefka | 339/17 C |
| 4,521,065 | 6/1985 | Nestor et al. | 339/75 MP |

FOREIGN PATENT DOCUMENTS

| | | |
|---|---|---|
| 147039 | 7/1985 | European Pat. Off. . |
| 2061862 | 6/1971 | France . |
| 1121805 | 7/1968 | United Kingdom . |
| 1205386 | 9/1970 | United Kingdom . |
| 1541366 | 2/1979 | United Kingdom . |

*Primary Examiner*—Neil Abrams

*Attorney, Agent, or Firm*—Roger H. Criss

[57] ABSTRACT

In an electric printed circuit board assembly a printed circuit board (1) has a cut-out (2) along an edge for receiving an edge loaded multi-contact electrical connector (3) the connector having a part which lies along the surface opposite to that engaged by the contacts and end grooves (6, 7) for receiving the end edge parts (8, 9) of the cut-out having inwardly directed detents (13) for engaging recesses (16) of the board and affording snap-in planar loading of the connector to the board.

11 Claims, 8 Drawing Figures

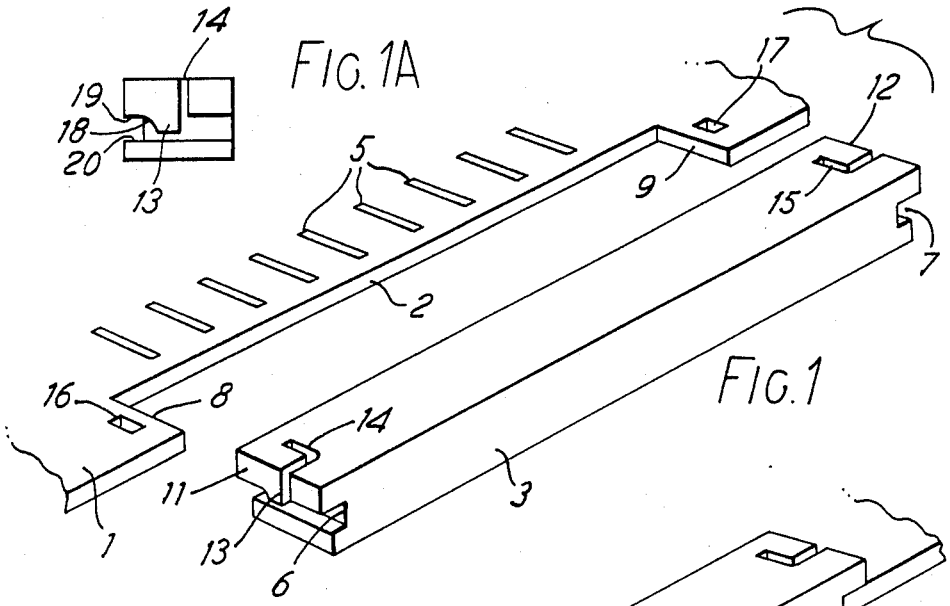
FIG. 1A
FIG. 1
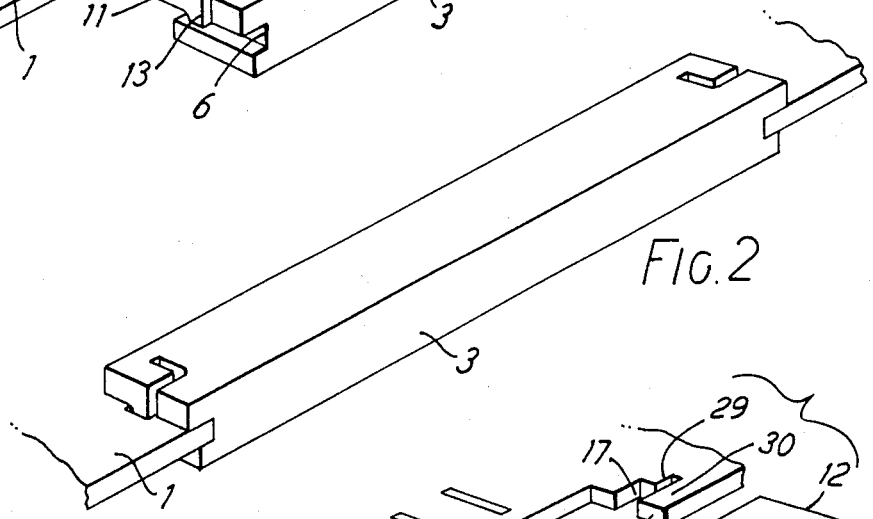
FIG. 2
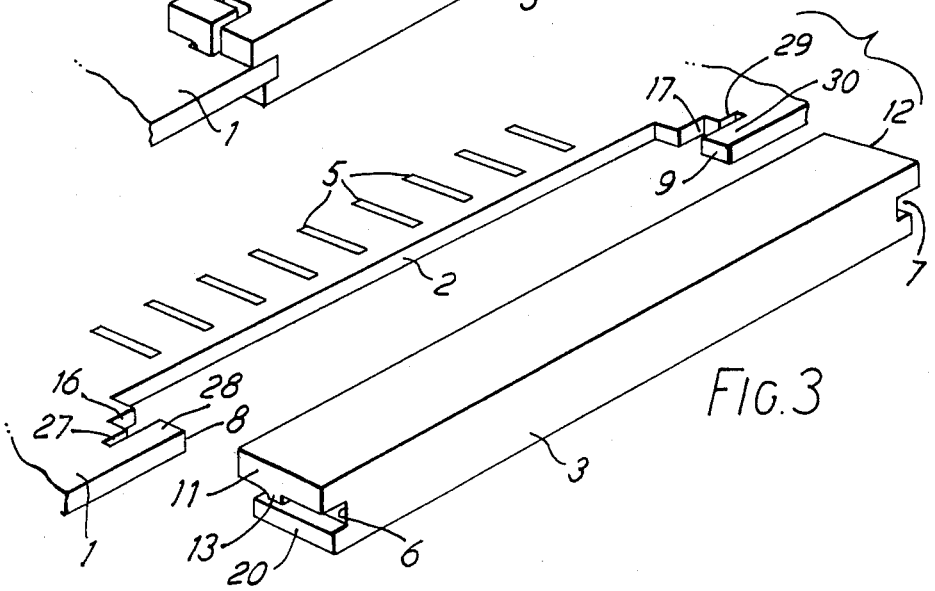
FIG. 3

ELECTRIC CIRCUIT BOARD ASSEMBLY

BACKGROUND OF THE INVENTION

1. Field of the Invention

This invention relates to an electric circuit board assembly and relates more especially to assembly of an electrical connector with a circuit board.

2. Description of the Prior Art

Hitherto electric circuit boards have had edge mounted multicontact connectors manually face mounted to them by means of suitable face mounting flanges and screws or rivets. With the use of automated assembly techniques however it can be a disadvantage for manual assembly of such connectors to still be necessary and it would be desirable to reduce or remove this disadvantage or provide for simpler assembly.

In addition, most board-to-board connectors were designed for use with circuits employing discrete components and are very large when compared to modern circuitry employing surface mount devices. Consequently, it is the physical design of the connector which dictates board spacing, and hence overall equipment size. It would likewise be desirable to alleviate this problem.

SUMMARY OF THE INVENTION

According to the present invention there is provided an electric circuit board assembly comprising a circuit board and an electrical component mounted thereto, the board comprising a cut-out having an edge part and mounting means, and the component having a body formed with means to receive the edge part of the board and mounting means on the component engageable with the mounting means on the board providing snap-together engagement between the edge part and the body.

Preferably, the attachment means on the board includes a recess and the attachment means on the component, which is preferably a connector, includes an inwardly-projecting detent.

Further in accordance with this invention, there is provided an electrical connector for mounting on an edge of a printed circuit board, the connector comprising a body including contacts therein for making connection to contacts on the board, and mounting means for mounting the connector to the board providing snap-together engagement between the edge and the body, the mounting means including grooves located on the ends of the connector adapted to receive the edge of the board, and inwardly projecting detent means adjacent to the grooves and adapted to engage the mounting means on the board.

The assembly of this invention can be provided by automatic assembly techniques. The connector itself has a very low height when mounted on the board, and extends from the surface by an amount which compares to that required for surface mount electrical components.

BRIEF DESCRIPTION OF THE DRAWINGS

FIG. 1 shows a printed circuit board and an edge mountable component in diagrammatic form.

FIG. 1A is an inset end view of the edge mountable component of FIG. 1.

FIG. 2 shows the board and the component assembled together.

FIG. 3 shows an alternative printed circuit board and edge mountable component in diagrammatic form.

DESCRIPTION OF THE PREFERRED EMBODIMENTS

Figure 4:
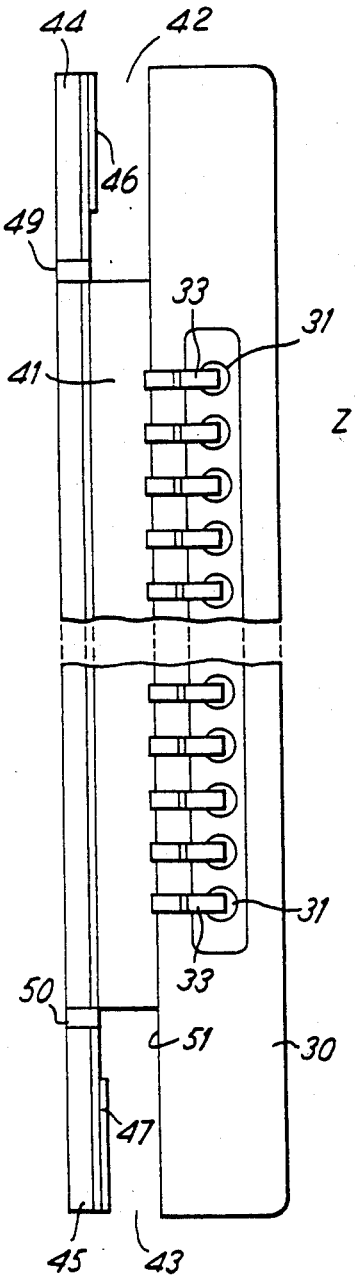
FIGS. 4, 5, 6 and 7 show in greater detail front, plan, sectional and end views, respectively, of a preferred form of an edge-mountable printed circuit board connector.

Referring to FIG. 1 a printed circuit board has a rectangular cut-away 2, the cut-away being dimensioned to receive an edge-loaded molded plastic multiconductor cable connector 3 of which the contact details are not shown. The design is such that connections are capable of being established between springy contacts thereof and respective face contacts or traces such as indicated at 5 spaced along the edge on one side of the circuit board.

In order to facilitate loading of the connector block 3 to the edge of the circuit board the ends of the block are provided with grooves 6 and 7 which are dimensioned to slidingly accomodate respective edge parts 8 and 9 at extremities of a cut-away 2 of the board 1. Further, end parts 11 and 12 on the top sides of these grooves are provided with downward detents such as 13 clearly shown in the inset end view of FIG. 1. Generally L-shaped cuts 14 and 15 render the end parts 11, 12 with the detents resiliently deflectable, permitting them on assembly to ride over the top surface of the circuit board and to then engage in respective rectangular apertures 16 and 17 to positively lock the connector block into position in the cut-away 2 of the circuit board 1 as shown in FIG. 2. Alternatively, it may be desirable to provide detents on the board and recesses on the connector.

Reference to the FIG. 1A in-set view of the connector block of FIG. 1 reveals not only a curved leading surface 18 of the detent which facilitates assembly but also a longitudinal inner groove 19 which snugly accomodates the longitudinal edge of the cut-away 2 of the circuit board to afford a rigid assembly and maintain good contact between springy contacts (not shown) in the connector and the face contacts 5, the lower part 20 being continuously pressed against the underside of the edge part 8. The same is true of the other end engaging with edge part 9.

Whereas in the assembly shown in FIGS. 1 and 2, the resilient part 11 carrying the detent 13 is on the same side of the circuit board as the contacts 5 and the rigid part 20 is maintained in contact with the other face, the opposite arrangement may be provided if desired. In that case the rigid part may engage positively with the face of the circuit board bearing the contacts with the possible advantage that movement of the springy contacts relative to the board contacts 5 is even less likely to occur after assembly.

Another alternative arrangement is shown in FIG. 3, wherein the same reference numerals are used for the parts which correspond to FIG. 1. The detent 13 is carried rigidly by the component 3 whereas the edge part 8 of the printed circuit board 1 is provided not only with a recess 16 corresponding to the recess 16 of FIG. 1, but also a slot 27. This slot is of sufficient length to enable the part 28 of the board to resiliently deflect under the action of the leading surface 18 during the edge loading operation to permit the detent 13 to engage as before in the recess 16. The other end of component 3 is similarly now provided for the same reasons with a rigid detent and the corresponding edge part 9 is provided with a slot 29 to render the part 30 resiliently deflectable by a respective detent during the assembly operation.

By virtue of the generally L-shaped cuts 14 and 15 the assembly is able to accomodate differential expansions between the block 3 and the board 1 during subsequent heating for any reason such as soldering.

The connector 3 may be designed as a female connector (or header) into which a male connector can be inserted for connecting a multiconductor cable to the board. Alternatively the connector may be designed itself to receive a multiconductor cable by insulation displacement contacts (IDC) or other known connection means.

Figure 5:
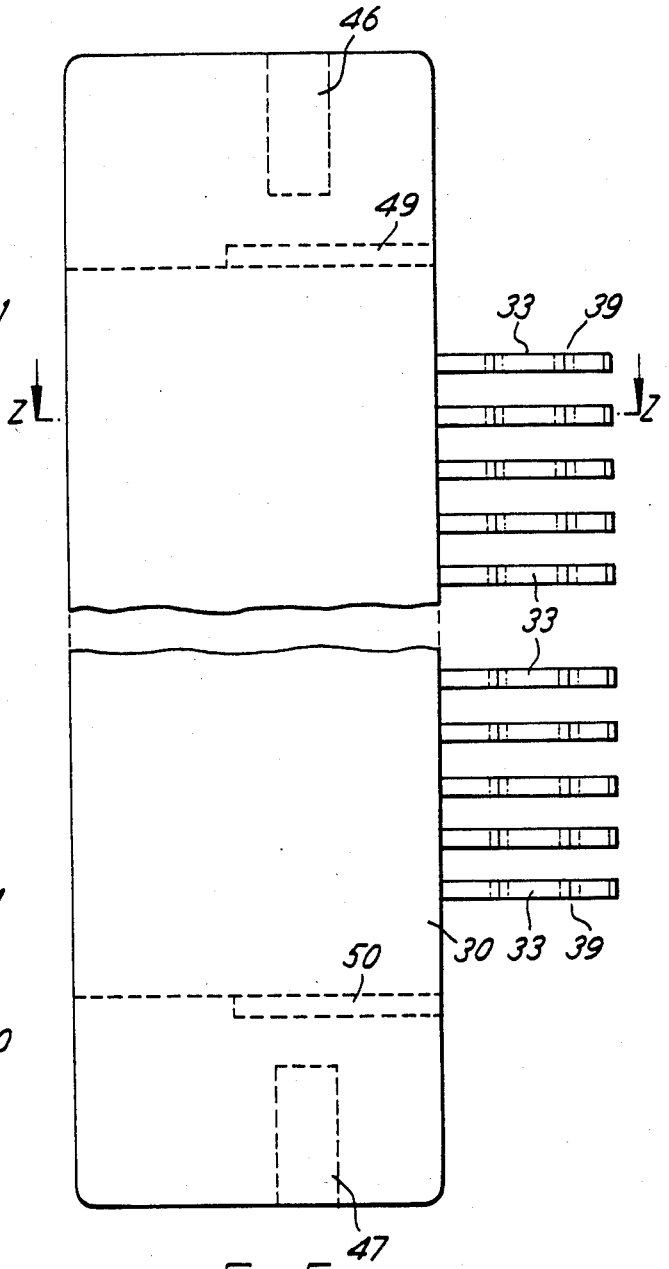

A preferred form of the connector 3 is illustrated on an enlarged scale in FIGS. 4, 5, 6, and 7 which illustrate a front view, a plan view, a sectional view along line z—z of FIG. 5, and an end view of such a connector. The connector has a molded plastic body denoted by reference 30 and provided with a plurality of equally spaced recessed apertures 31 for receiving springy contacts shaped as seen at 33 in FIG. 6. The apertures 31 lead into spaced recesses 32 divided one from the next by integrally molded ribs 38. Each recess 32 opens into a common rectangular chamber 34 having a tapered mouth 35 for receiving a free plug-in connector (not shown) carrying similarly spaced contacts which thereby register with the respective springy contacts 33. Contact with a male plug-in connectors takes place at a respective knee 36 which resiliently project from recesses 32 for such purpose into chamber 34. The springy contacts 33 are retained in position in respective apertures 31 in the plastic body molding by means of a potting compound indicated at 37, are retained in alignment parallel to one another by the internal ribs 38 and have outer curved portions 39 which register and make contact with respective surface contacts when assembled to the printed circuit board.

Figure 7:
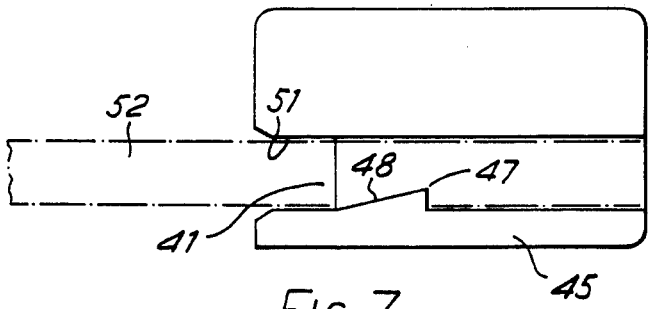

As seen in FIG. 4 and FIG. 7 the body 30 of the connector is provided with a longitudinal groove denoted by reference 41 opening out at either end into respective grooves 42 and 43 designed to engage with the end edge parts of a cut-out of a circuit board, such as ends 8 and 9 of FIG. 1. Furthermore, the underside parts 44 and 45 of the body 30 are provided with detents 46 and 47, detent 47 being as shown in the end view of FIG. 7. The detents 46 and 47 are thus of generally saw-tooth shape providing them with a suitable ramp face for deflection over the surface of the board before springing back into engagement with a respective recess to lock the body in place in a similar manner to that described with reference to FIG. 1. The resilience required for permitting such deflection of the detent over the board surface is provided by a molded-in slots 49 and 50 such as previously described with reference to FIG. 1. However, the slots are now applied to parts 44 and 45 which engage the side of the printed circuit board opposite to that carrying the contacts.

Figure 6:
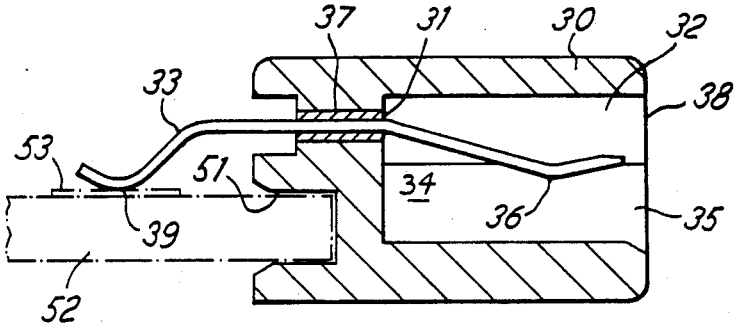

The multi-contact connector body 30 is assembled by planar motion to a cutaway at the edge of a printed circuit board as shown in FIG. 1, the spacing of the end edge parts of the cutaway being such as to afford accurate registration of the bases of end-grooves 42 and 43 and therefore of the respective springy contacts 33 with respective surface contacts of the circuit board. The assembled circuit board is indicated by a broken outline 52 in FIGS. 6 and 7 and a surface contact at 53 in FIG. 6. The resilient under-parts 44 and 45 then act to pull the upper surface into constant contact with the adjacent board surface and maintain good electrical contact between points 39 of contacts 33 and the respective surface contacts. In eventual use a multi-contact male plug connector is inserted at the mouth 35 to complete the required connections therewith at points 36 (FIG. 6).

The connector can be used as an input-output or a board-to-board connector. Since assembly of a connector and a circuit board can be achieved by a simple planar relative movement between the connector body and the circuit board of the above described examples of the invention such an assembly may lend itself either to efficient manual or to efficient automated production techniques.

Furthermore, the connector has a very low profile so that it does not extend very much above the board when mounted. Indeed, the height of the connector from the board is similar to the height of surface mount components extending from the board.

What is claimed is:

1. An electric circuit board assembly comprising an electric circuit board and an electrical connector mounted thereto, said board comprising a front edge, a centrally located substantially rectangularly shaped cut-out in said front edge, said cut-out being defined by oppositely facing side edge parts and a substantially straight front edge surface, recess means provided on said board adjacent to each of said side edge parts of said cut-out, and a plurality of face contacts on a first surface of said board extending towards said front edge surface and being electrically connected to said connector;

said connector having an elongated body including a front surface, a back surface, a top surface, a bottom surface and opposite side edges, a groove in each of said side edges of said body extending from said front surface to said back surface, electrical contacts in said body in electrical connection with said face contacts, said body having a width substantially equal to the length of said substantially straight front edge surface of said cut-out and said side edge parts of said cut-out being received in said grooves of said connector, such that said back surface of said body is substantially flush with said front edge of said board adjacent to said side edge parts, detent means integral with said body and extending downwardly into said grooves and being received in said recess means to retain said board and said connector together, a slot partially separating said detent means from said body whereby said detent means is resiliently deflectable from said body to permit entry of said detent means into the respective recess means in the action of loading said body to said board in a direction planar to said board to provide a snap-together engagement between said board and said connector.

2. The assembly of claim 1, wherein said slots partially separating said detent means from said body are generally L-shaped.

3. The assembly of claim 2, werein said body is a unitary molded plastic body.

4. The assembly of claim 3, wherein said front surface of said body comprises an upper front surface and a lower front surface, said upper front surface extending over and lying against said first surface of said board, and said lower front surface extending over and lying against a second surface of said board opposite to said first surface, and an inner groove extending between said upper front surface and said lower front surface, said inner groove receiving said front edge surface of said cut-out.

5. The assembly of claim 4, wherein said detent means comprises a detent having a curved surface facing said board.

6. The assembly of claim 5, wherein said recess means comprises a rectangular aperture in said board.

7. An electric circuit board assembly comprising an electric circuit board and an electrical connector mounted thereto, said board comprising a front edge, a centrally located substantially rectangularly shaped cut-out in said front edge, said cut-out being defined by oppositely facing side edge parts and a substantially straight front edge surface, recess means provided on said board adjacent to each said side edge parts of said cut-out, said side edge parts including a slot connecting with said recess means and defining a forward part which is partially separated from said board, and a plurality of face contacts on a first surface of said board extending towards said front edge surface and being electrically connected to said connector;

said connector having an elongated body including a front surface, a back surface, a top surface, a bottom surface and opposite sides edges, a groove in each of said side edges of said body extending from said front surface to said back surface, electrical contacts in said body in electrical connection with said face contacts, said body having a width substantially equal to the length of said substantially straight front edge surface of said cut-out and said side edge parts of said cut-out being received in said grooves of said connector, such that said back surface of said body is substantially flush with said front edge of said board adjacent to said side edge parts, detent means integral with said body and extending downwardly into said grooves and being received in said recess means to retain said board and said connector together, said forward part being resiliently deflectable from said board to permit entry of said detent means into the respective recess means in the action of loading said body to said board in a direction planar to said board to provide a snap-together engagement between said board and said connector.

8. The assembly of claim 7, wherein said slot is substantially parallel to said front edge of said board.

9. The assembly of claim 8, wherein said body is a unitary molded plastic body.

10. The assembly of claim 9, wherein said front surface of said body comprises an upper front surface and a lower front surface, said upper front surface extending over and lying against said first surface of said board, and said lower front surface extending over and lying against a second surface of said board opposite to said first surface, and an inner groove extending between said upper front surface and said lower front surface, said inner groove receiving said front edge surface of said cut-out.

11. The assembly of claim 10, wherein said detent means comprises a rigid detent having a curved surface facing said board.

* * * * *